US010753104B2

(12) United States Patent
Van Hooydonck

(10) Patent No.: US 10,753,104 B2
(45) Date of Patent: Aug. 25, 2020

(54) FLOOR PANEL FOR FORMING A FLOOR COVERING

(71) Applicant: FLOORING INDUSTRIES LIMITED, SARL, Bertrange (LU)

(72) Inventor: Guy Van Hooydonck, Schoten (BE)

(73) Assignee: Flooring Industries Limited, SARL, Bertrange (LU)

( * ) Notice: Subject to any disclaimer, the term of this patent is extended or adjusted under 35 U.S.C. 154(b) by 0 days.

(21) Appl. No.: 16/573,287

(22) Filed: Sep. 17, 2019

(65) Prior Publication Data

US 2020/0011069 A1 Jan. 9, 2020

Related U.S. Application Data

(62) Division of application No. 15/543,880, filed as application No. PCT/IB2016/050197 on Jan. 15, 2016, now Pat. No. 10,428,535.

(60) Provisional application No. 62/103,960, filed on Jan. 15, 2015.

(51) Int. Cl.
*E04F 15/02* (2006.01)
*E04F 15/10* (2006.01)

(52) U.S. Cl.
CPC ..... *E04F 15/02038* (2013.01); *E04F 15/105* (2013.01); *E04F 2201/0146* (2013.01); *E04F 2201/0161* (2013.01)

(58) Field of Classification Search
CPC ..... E04F 2201/023; E04F 15/02038; E04F 19/061; E04F 19/06; E04F 19/02; E04F 13/0871; E04F 11/163; E04F 19/022; F16B 5/0056; F16B 5/00; F16B 5/0012; F16B 5/0004; E04B 2001/3276; E04B 1/34321; E04B 2002/7483; E04B 2001/3252; E04B 1/6804; E04B 1/6809; B27M 3/08; A47B 47/0075; A47B 2230/0096
See application file for complete search history.

(56) References Cited

U.S. PATENT DOCUMENTS 6,006,486 A * 12/1999 Moriau ..... B27F 1/06 52/589.1
8,720,150 B2 5/2014 Hannig
9,175,475 B2 11/2015 Hannig
2009/0193741 A1* 8/2009 Cappelle ..... E04F 15/02033 52/309.1
2010/0281803 A1 11/2010 Cappelle
2013/0232905 A2 9/2013 Pervan
(Continued)

FOREIGN PATENT DOCUMENTS

EP 2275623 A2 1/2011
EP 2339092 A1 6/2011
(Continued)

OTHER PUBLICATIONS

International Search Report from PCT Application No. PCT/IB2016/050197, dated Apr. 29, 2016.

*Primary Examiner* — Gisele D Ford
(74) *Attorney, Agent, or Firm* — Workman Nydegger

(57) ABSTRACT

Floor panel, characterized in that it is of the type that can be installed according to the fold down-technique, that it comprises coupling means in one piece on all four edges, and that measures are taken in order to avoid an undesired shifting on the long edges during the turning down of the floor panel.

12 Claims, 4 Drawing Sheets

(56) References Cited

U.S. PATENT DOCUMENTS

| | | | |
|---|---|---|---|
| 2013/0276398 | A1 | 10/2013 | Hannig |
| 2013/0309441 | A1 | 11/2013 | Hannig |
| 2014/0283477 | A1 | 9/2014 | Hannig |
| 2014/0318070 | A1 | 10/2014 | Schacht et al. |
| 2018/0010342 | A1* | 1/2018 | Van Hooydonck ..... E04F 15/02038 |

FOREIGN PATENT DOCUMENTS

| | | | |
|---|---|---|---|
| WO | 2012084604 | A1 | 6/2012 |
| WO | 2015130169 | A1 | 9/2015 |

* cited by examiner

FLOOR PANEL FOR FORMING A FLOOR COVERING

This application is a divisional of U.S. application Ser. No. 15/543,880 filed Jul. 14, 2017, which claims the benefit under 35 U.S.C. 119(e) to the U.S. provisional applications No. 62/103,960 filed on Jan. 15, 2015, the entirety of which is incorporated herein by reference.

BACKGROUND OF THE INVENTION

1. Field of the Invention

This invention relates to a floor panel for forming a floor covering, more particularly for forming a floor covering which can be installed on an underlying surface.

More particularly, it relates to floor panels which can be coupled to each other by means of mechanical coupling parts.

2. Related Art

Still more particularly, it relates to floor panels of the type wherein such floor panel is rectangular and oblong and thus comprises a first pair of opposite edges, which form the long edges of the floor panel, as well as comprises a second pair of opposite edges, which form the short edges of the floor panel; wherein both pairs of opposite edges comprise coupling parts, which allow that a plurality of such floor panels mutually can be coupled to each other; wherein these coupling parts, on both pairs of edges, form a first locking system, which, in a coupled condition of two of such floor panels, effects a locking in the plane of the floor panels and perpendicular to the respective edges, thus, in horizontal direction; as well as form a second locking system, which, in a coupled condition of two of such floor panels, effects a locking transverse to the plane of the floor panels, thus, in vertical direction; wherein these coupling parts on the first pair of opposite edges substantially are realized in the material of the floor panel itself; wherein the coupling parts of at least the first pair of opposite edges are configured such that two of such floor panels can be coupled to each other at these edges by means of a turning movement and to this aim these coupling parts on the first pair of opposite edges consist of a tongue and a groove, as well as of locking parts, which, in the coupled condition, prevent the shifting apart of the tongue and groove; wherein on the first pair of opposite edges the groove is bordered by a lower lip and an upper lip, of which the lower lip extends laterally up to beyond the distal extremity of the upper lip; wherein the coupling parts on the second pair of edges are configured such that two of such floor panels can be coupled to each other at these edges by means of a downward movement of one floor panel in respect to the other, more particularly such that a plurality of such floor panels can be coupled to each other by means of the so-called "fold-down" technique; wherein the first locking system of the second pair of edges is at least formed of an upward-directed lower hook-shaped part, which is situated on one of said two edges and which comprises a distal extremity, as well as a downward-directed upper hook-shaped part, herein below sometimes also called hook-shaped element, which is situated on the opposite edge, wherein the lower hook-shaped part consists of a lip with an upward-directed locking element, whereas the upper hook-shaped part or element consists of a lip with a downward-directed locking element; wherein the second locking system of the second pair of edges is at least formed by a locking part, which is situated on the distal extremity of the lower hook-shaped part, as well as a locking part, which cooperates therewith in the coupled condition of two of such floor panels, on the edge which comprises the upper hook-shaped part; and wherein the distal extremity of the upper hook-shaped part and the side which, in coupled condition, is opposite thereto, are free from mutually vertically locking parts or alternatively indeed are provided with mutually vertically locking parts on this last-mentioned location.

SUMMARY OF THE DISCLOSURE

Floor panels of this type are advantageous in certain respect; however, a disadvantage is that the presence of the locking part at the distal extremity of the lower hook-shaped part can create undesired permanent displacements, shifting apart, respectively, at the first pair of edges. The invention substantially offers three solutions for minimizing the chance that such displacements occur, this by providing for well-defined combinations, more particularly by applying well-defined characteristics on the short sides or edges with specific characteristics on the long sides or edges.

Herein after, the solutions are defined as three independent aspects, wherein each of these aspects further also provides for a deviating alternative.

The first two aspects relate to solutions which provide for creating certain tensions in the coupling parts on the long sides, such that the risk of shifting apart is counteracted. The third aspect provides for a solution providing that a so to speak tensionless joining on the long edges is possible, such that certainly no effect contributing to the occurrence of undesired gaps is created.

The solutions, such as presented by the first two independent aspects, can be combined with each other, whereas the third independent aspect offers a separate solution.

According to the first aspect of the invention, it relates to a floor panel for forming a floor covering, wherein this floor panel is rectangular and oblong and thus comprises a first pair of opposite edges, which form the long edges of the floor panel, as well as comprises a second pair of opposite edges, which form the short edges of the floor panel; wherein both pairs of opposite edges comprise coupling parts, which allow that a plurality of such floor panels mutually can be coupled to each other; wherein these coupling parts, on both pairs of edges, form a first locking system, which, in a coupled condition of two of such floor panels, effects a locking in the plane of the floor panels and perpendicular to the respective edges, as well as form a second locking system, which, in a coupled condition of two of such floor panels, effects a locking transverse to the plane of the floor panels; wherein these coupling parts on the first pair of opposite edges substantially are realized in the material of the floor panel itself; wherein the coupling parts of at least the first pair of opposite edges are configured such that two of such floor panels can be coupled to each other at these edges by means of a turning movement and to this aim these coupling parts on the first pair of opposite edges consist of a tongue and a groove, as well as of locking parts, which, in the coupled condition, prevent the shifting apart of the tongue and groove; wherein on the first pair of opposite edges the groove is bordered by a lower lip and an upper lip, of which the lower lip extends laterally up to beyond the distal extremity of the upper lip; wherein the coupling parts on the second pair of edges are configured such that two of such floor panels can be coupled to each other at these edges by means of a downward movement of one floor panel in respect to the other, more particularly such that a plurality of such floor panels can be coupled to each other by means of the so-called "fold-down" technique; wherein the first locking system of the second pair of edges is at least formed of an upward-directed lower hook-shaped part, which is situated on one of said two edges and which comprises a distal extremity, as well as a downward-directed upper hook-shaped part, which is situated on the opposite edge, wherein the lower hook-shaped part consists of a lip with an upward-directed locking element, whereas the upper hook-shaped part, in other words, upper hook-shaped element, consists of a lip with a downward-directed locking element; wherein the second locking system of the second pair of edges is at least formed by a locking part, which is situated on the distal extremity of the lower hook-shaped part, as well as a locking part, which cooperates therewith in the coupled condition of two of such floor panels, on the edge which comprises the upper hook-shaped part; wherein the distal extremity of the upper hook-shaped part and the side which, in coupled condition, is opposite thereto, are free from mutually vertically locking parts, with the characteristic that the coupling parts on the first pair of edges are configured such that during the turning into each other of two of such floor panels an elastic force has to be overcome during the turning movement, which force, during the turning into each other, first increases in order to subsequently decrease again; that the floor panels on the first pair of edges, in the final coupled condition of two of such floor panels, are coupled in horizontal direction free from play, or, if such play indeed exists, this play is less than 0.2 mm; that the aforementioned locking parts of the first locking system on the first pair of edges are formed at least of a locking part on the lower side of the tongue and a locking part on the aforementioned lower lip, which, by means of contact surfaces, which can cooperate with each other, result in the respective locking; and that the coupling parts on the first pair of edges in the coupled condition show one or both of the following characteristics:

- in the direction of the distal extremity of the tongue, at the same height as the aforementioned contact surfaces, a free space is present between the tongue, including the locking part, and the opposite floor panel;
- the cooperation of the aforementioned contact surfaces defines a tangent line which, in respect to the horizontal, forms an angle of at least 40 degrees.

According to a preferred embodiment, the floor panel of the first aspect further is characterized in that the elastic force is delivered in that the coupling parts are configured such that the locking parts on tongue and groove during the turning movement can pass alongside each other exclusively be exerting a force. More particularly, it is preferred that the elastic force substantially or at least is the result of an elastic bending in the lower lip. According to another possibility, the elastic force substantially shall be the result of an elastic deformation in the material of the locking parts themselves. Of course, a combination is also possible.

According to the second aspect of the invention, it relates to a floor panel for forming a floor covering, wherein this floor panel is rectangular and oblong and thus comprises a first pair of opposite edges, which form the long edges of the floor panel, as well as comprises a second pair of opposite edges, which form the short edges of the floor panel; wherein both pairs of opposite edges comprise coupling parts, which allow that a plurality of such floor panels mutually can be coupled to each other; wherein these coupling parts, on both pairs of edges, form a first locking system, which, in a coupled condition of two of such floor panels, effects a locking in the plane of the floor panels and perpendicular to the respective edges, as well as form a second locking system, which, in a coupled condition of two of such floor panels, effects a locking transverse to the plane of the floor panels; wherein these coupling parts on the first pair of opposite edges substantially are realized in the material of the floor panel itself; wherein the coupling parts of at least the first pair of opposite edges are configured such that two of such floor panels can be coupled to each other at these edges by means of a turning movement and to this aim these coupling parts on the first pair of opposite edges consist of a tongue and a groove, as well as of locking parts, which, in the coupled condition, prevent the shifting apart of the tongue and groove; wherein on the first pair of opposite edges the groove is bordered by a lower lip and an upper lip, of which the lower lip extends laterally up to beyond the distal extremity of the upper lip; wherein the coupling parts on the second pair of edges are configured such that two of such floor panels can be coupled to each other at these edges by means of a downward movement of one floor panel in respect to the other, more particularly such that a plurality of such floor panels can be coupled to each other by means of the so-called "fold-down" technique; wherein the first locking system of the second pair of edges is at least formed of an upward-directed lower hook-shaped part, which is situated on one of said two edges and which comprises a distal extremity, as well as a downward-directed upper hook-shaped part, which is situated on the opposite edge, wherein the lower hook-shaped part consists of a lip with an upward-directed locking element, whereas the upper hook-shaped part consists of a lip with a downward-directed locking element; wherein the second locking system of the second pair of edges is at least formed by a locking part, which is situated on the distal extremity of the lower hook-shaped part, as well as a locking part, which cooperates therewith in the coupled condition of two of such floor panels, on the edge which comprises the upper hook-shaped part; wherein the distal extremity of the upper hook-shaped part and the side which, in coupled condition, is opposite thereto, are free from mutually vertically locking parts; with the characteristic that the coupling parts on the first pair of edges are configured such that the floor panels on this first pair of edges, in the final coupled condition of two of such floor panels, are coupled in horizontal direction with a tensioning force which presses the floor panels at their upper edges substantially permanently towards each other, more particularly a so-called "pre-tension", which tensioning force is built up during the turning in.

According to a preferred embodiment, the floor panel of the second aspect further is characterized in that the aforementioned locking parts of the first locking system on the first pair of edges are formed at least by a locking part on the lower side of the tongue and a locking part on said lower lip, which provide for the respective locking via contact surfaces, which can cooperate with each other.

Further, it is preferred that the tensioning force is at least the result of a configuration which provides for that the lower lip is elastically bent out in the final coupled condition and/or is at least the result of a configuration which provides for that the respective locking parts are elastically impressed in the final coupled condition.

According to a preferred embodiment, such floor panel, which fulfills the requirements of the second aspect, can show the feature that the coupling parts on the first pair of edges in the coupled condition show the characteristic that, in the direction of the distal extremity of the tongue, at the same height as said contact surfaces, a free space is present between the tongue, including the locking part, and the opposite floor panel, and/or that the cooperation of said contact surfaces define a tangent line which, in respect to the horizontal, forms an angle of at least 40 degrees.

According to the third aspect of the invention, it relates to a floor panel for forming a floor covering, wherein this floor panel is rectangular and oblong and thus comprises a first pair of opposite edges, which form the long edges of the floor panel, as well as comprises a second pair of opposite edges, which form the short edges of the floor panel; wherein both pairs of opposite edges comprise coupling parts, which allow that a plurality of such floor panels mutually can be coupled to each other; wherein these coupling parts, on both pairs of edges, form a first locking system, which, in a coupled condition of two of such floor panels, effects a locking in the plane of the floor panels and perpendicular to the respective edges, as well as form a second locking system, which, in a coupled condition of two of such floor panels, effects a locking transverse to the plane of the floor panels; wherein these coupling parts on the first pair of opposite edges substantially are realized in the material of the floor panel itself; wherein the coupling parts of at least the first pair of opposite edges are configured such that two of such floor panels can be coupled to each other at these edges by means of a turning movement and to this aim these coupling parts on the first pair of opposite edges consist of a tongue and a groove, as well as of locking parts, which, in the coupled condition, prevent the shifting apart of the tongue and groove; wherein on the first pair of opposite edges the groove is bordered by a lower lip and an upper lip, of which the lower lip extends laterally up to beyond the distal extremity of the upper lip; wherein the coupling parts on the second pair of edges are configured such that two of such floor panels can be coupled to each other at these edges by means of a downward movement of one floor panel in respect to the other, more particularly such that a plurality of such floor panels can be coupled to each other by means of the so-called "fold-down" technique; wherein the first locking system of the second pair of edges is at least formed of an upward-directed lower hook-shaped part, which is situated on one of said two edges and which comprises a distal extremity, as well as a downward-directed upper hook-shaped part, which is situated on the opposite edge, wherein the lower hook-shaped part consists of a lip with an upward-directed locking element, whereas the upper hook-shaped part consists of a lip with a downward-directed locking element; wherein the second locking system of the second pair of edges is at least formed by a locking part, which is situated on the distal extremity of the lower hook-shaped part, as well as a locking part, which cooperates therewith in the coupled condition of two of such floor panels, on the edge which comprises the upper hook-shaped part; wherein the distal extremity of the upper hook-shaped part and the side which, in coupled condition, is opposite thereto, are free from mutually vertically locking parts; with the characteristic that the coupling parts on the first pair of edges are configured such that they allow a tensionless turning into each other up into the final coupled condition, more particularly without building up a so-called pre-tension, or without having to overcome a temporary elastic force or substantial elastic force.

According to a preferred embodiment, the floor panel of the third aspect is characterized in that the floor panels on the first pair of edges, in the final coupled condition of two of such floor panels, are coupled in horizontal direction free from play or, if such play indeed is present, it is less than 0.2 mm. Such characteristic is obtained by mutually attuned combinations of the respective coupling parts. In the present context, the term play always relates to the condition at the visible upper edge of the coupled floor panels.

According to a preferred embodiment, the floor panel of the third aspect of the invention further is characterized in that the aforementioned locking parts of the first locking system on the first pair of edges are formed at least by a locking part on the lower side of the tongue and a locking part on said lower lip, which provide for the respective locking via contact surfaces, which can cooperate with each other.

According to a preferred embodiment, such floor panel, which fulfills the requirements of the third aspect, can show the feature that the coupling parts on the first pair of edges in the coupled condition show the characteristic that, in the direction of the distal extremity of the tongue, at the same height as the aforementioned contact surfaces, a free space is present between the tongue, including the locking part, and the opposite floor panel, and/or that the cooperation of the aforementioned contact surfaces defines a tangent line which, in respect to the horizontal, forms an angle of at least 40 degrees.

Further, all herein above-described floor panels of the first, second and third aspect also may show various preferred characteristics, as will be explained herein below. All preferred characteristics, those which are described herein above as well as those which are described herein below, can be combined at choice, at least in as far as the combinations do not comprise contradictory definitions.

In a preferred embodiment, a floor panel is characterized in that the locking elements of the hook-shaped parts comprise locking surfaces, which provide for the horizontal locking and determine a tangent line, which either is directed inward and they thus manifest themselves as an undercut, or define a tangent line which is situated perpendicular to the plane of the floor panels, or define a tangent line which is directed outward, however, in the last case with an angle of maximum 30 degrees in respect to the vertical.

In a preferred embodiment, the floor panel of the first, second or third aspect further is characterized in that the locking part of the second locking system, which is situated on the distal extremity of the lower hook-shaped part, and/or the corresponding locking part on the other edge, massively form part of the coupling parts or the floor panels, or at least are massively supported directly towards the back and thus no grooves or the like are present there behind which have the purpose of creating movable parts, such over the majority of the length of the edge concerned.

According to a deviating embodiment, a floor panel of the first, second or third aspect, the floor panel according to the invention is characterized in that instead of the fact that "the distal extremity of the upper hook-shaped part and the side situated opposite thereto in the coupled condition of two floor panels, are free from vertically locking parts", now indeed such locking parts are present, wherein preferably the thereby formed locking surfaces thereof, in the coupled condition, are situated entirely above a horizontal level, which is determined by the highest point of the upward-directed locking part of the lower hook-shaped part. According to the invention, thus, this deviation may be applied to floor panels according to the first aspect, as well as to floor panels according to the second aspect, as well as to floor panels according to the third aspect. All subordinate characteristics described herein above as well as herein below can also be applied to these deviating embodiments.

According to a particular possibility, the floor panel of the invention substantially is realized on the basis of synthetic material and preferably as a layer-shaped substrate formed of one or more layers. Still more particularly, it can be realized as a floor panel of the supple type, more particularly is of the so-called "resilient floor" type.

More particularly, it is preferred that the floor panel substantially is composed of a thermoplastic material, preferably a soft thermoplastic material, or that at least minimum one or more basic layers of the floor panel consist of such material.

Still more particularly, it is preferred that the floor panel of the first, second or third aspect substantially is realized on the basis of vinyl, such as polyvinyl chloride, more particularly on the basis of soft polyvinyl chloride, or at least comprises minimum one or more basic layers which are realized on the basis of polyvinyl chloride, more particularly soft polyvinyl chloride, or alternatively on the basis of polyurethane or polypropylene or a similar synthetic material.

According to another particularly preferred embodiment, it relates to a vinyl panel, more particularly a so-called vinyl tile, and in particular a floor panel of the so-called LVT type ("Luxury Vinyl Tile") or VCT type ("Vinyl Composite Tile", also called "Vinyl Composition Tile").

In the case that such floor panel is realized on the basis of synthetic material, it is preferred that the actual floor panel, and thus more particularly the substrate thereof, comprises plasticizers.

The actual floor panel, and thus more particularly the substrate, can be provided with fillers, such as chalk or lime. Alternatively, such floor panel can also comprise wood particles, such as fibers and/or chips and/or wood dust or wood powder, and more particularly can be realized as WPC (Wood Plastic Composite). Also, both kinds of filler can be combined in the same floor panel.

Also, a floor panel according to the invention can be equipped with at least one reinforcement layer, preferably of glass fiber or the like.

In particular in the case that the floor panel is substantially realized on the basis of synthetic material, it shall preferably have a thickness of less than 8 mm, and still better than 5 mm.

Alternatively, such floor panel substantially can also consist of another material than the aforementioned materials. According to two important alternatives, it substantially consists of a laminate panel with a substrate of MDF or HDF or of a so-called engineered-wood panel. In these applications, the preferred thickness of the floor panels then is 5 to 10 mm.

In a particular embodiment, the invention shall be applied with synthetic material-based floor panels having a composed substrate, which may also be called hybrid floor panels. More particularly, this herein relates to a floor panel which substantially consists at least of two substrate layers, each having a well-defined thickness, namely a first synthetic material-based substrate layer and a second substrate layer situated there above, preferably directly there above, which second substrate layer has a thickness of at least 0.5 mm, preferably at least 1 mm; wherein this composed substrate, the floor panel concerned, respectively, also shows one of the following characteristics or any combination of these characteristics:

- the density of the first substrate layer is different from the density of the second substrate layer, and preferably the second substrate layer has a higher density than the first substrate layer;
- the first substrate layer is foamed, and preferably is of the closed cell type and still more preferably of the so-called hard foam type, and preferably the second substrate layer is not foamed or less foamed than the first substrate layer;
- the first substrate layer is extruded in plate shape or is formed to a plate by means of a strewing process and consolidation of the strewn material;
- the second substrate layer consists of an extruded layer or of a layer which is formed by means of a strewing process and consolidation of the strewn material;
- the two substrate layers are glued to each other or, alternatively, are consolidated in the same production process, this latter, for example, by mutual direct adherence between the materials of the substrates, or, for example, also by forming them of one composed matter with at least two layers;
- the contact surface of the vertical locking part, which is situated on the distal extremity of the lower hook-shaped part, is situated in the first substrate layer;
- the contact surfaces of the locking parts of the first pair of edges, which provide for the horizontal locking against the shifting apart, are situated in the first substrate layer.

In preferred embodiments of such floor panel with a composed substrate, this further may show one or more of the following characteristics, wherein not all contradictory combinations of characteristics are possible:

- that the aforementioned first substrate layer comprises at least a thermoplastic material;
- that the aforementioned first substrate layer is realized at least on the basis of polyvinyl chloride, polyethylene, polyurethane, polypropylene or PIR, or a combination of the preceding;
- that the aforementioned first substrate layer is a filled synthetic material composite, wherein this filling preferably consists at least of one or of a combination of the following materials: bamboo, cork and/or wood, and more particularly one or a combination of the aforementioned materials in the form of chips and/or fibers and/or dust or powder, such as sawdust;
- that the aforementioned first substrate layer is foamed;
- that the aforementioned first substrate layer is of the closed cell-type;
- that the aforementioned first substrate layer comprises one or more plasticizers; that the aforementioned first substrate layer comprises fillers, such as chalk and/or limestone and/or talc;
- that the aforementioned first substrate layer is provided with at least one reinforcement layer, preferably of glass fiber or the like;
- that the aforementioned first substrate layer has a thickness of at least 3 mm, preferably at least 4 mm, and still more preferably at least 5 mm;
- that the aforementioned first and/or second substrate layer is realized water-resistant; that the aforementioned second substrate layer is based on synthetic material;
- that the aforementioned second substrate layer comprises at least a thermoplastic material, which preferably is of the soft type;
- that the aforementioned second substrate layer is realized at least on the basis of vinyl, such as polyvinyl chloride, more particularly soft polyvinyl chloride, polyethylene, more particularly soft polyethylene, polyurethane, polypropylene, PIR or a combination of the preceding;
- that the aforementioned second substrate layer substantially consists of one or a combination of the following materials: wood veneer, rubber, linoleum, a paper-based or foil-based laminate sheet, or alternatively any material, more particularly cork, bamboo or wood veneer, which is encased by vinyl or resin;

that the aforementioned second substrate layer comprises one or more plasticizers;

that the aforementioned second substrate layer comprises fillers, such as chalk and/or limestone;

that the aforementioned second substrate layer is provided with at least one reinforcement layer, preferably of glass fiber or the like;

that the floor panel comprises a backing layer, which preferably is situated directly underneath the first substrate layer, which backing layer, for example, is realized on the basis of one or more of the following materials: cork, rubber and/or a soft foamed layer;

that the floor panel comprises a top layer, whether or not consisting of a plurality of layers, which preferably is situated directly above the second substrate layer, and/or that the second substrate layer is provided with a backing layer on the lower side of this second substrate layer;

that the aforementioned top layer comprises at least a decorative layer, preferably in the form of a print, preferably provided on a foil or film;

that the aforementioned top layer comprises at least a translucent or transparent wear layer and/or is provided with hard particles in order to increase the wear resistance, such as corundum;

that the floor panel has an overall thickness which is smaller than 10 mm, still better in the order of magnitude of 8 mm, or possibly thinner;

that the aforementioned first substrate layer is foamed gradually, wherein the degree of foaming increases in downward or in upward direction.

According to a preferred embodiment, a floor panel according to the invention is characterized in that the aforementioned locking parts of the first pair of edges are provided with locking contact surfaces, which, in the coupled condition, are situated at least partially in the portion of the lower lip which is situated beyond the distal extremity of the upper lip.

In another preferred embodiment, a floor panel according to the invention is characterized in that, on the first pair of opposite edges, the lower side of the upper lip is provided with a contact surface for the upper side of the tongue and that this contact surface is horizontal, or according to an alternative is slightly inclined at an angle with the plane of the floor panel, which angle is less than 10 degrees.

In the most preferred embodiment of the floor panels of the first, second or third aspect, the coupling parts on the second pair of edges are made in one piece from the material of the floor panels, preferably in the form of milled profiled parts.

BRIEF DESCRIPTION OF THE DRAWINGS

With the intention of better showing the characteristics of the invention, herein below, as an example without any limitative character, some preferred embodiments are described, with reference to the accompanying drawings, wherein.

DETAILED DESCRIPTION OF PREFERRED EMBODIMENTS OF THE INVENTION

Figure 1:
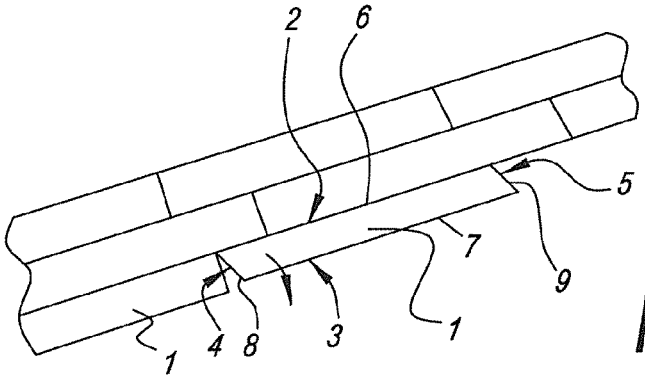
FIG. 1 schematically represents a part of a floor covering, which is realized by means of floor panels according to the invention, and in which the fold-down principle is shown schematically.
Figure 2:
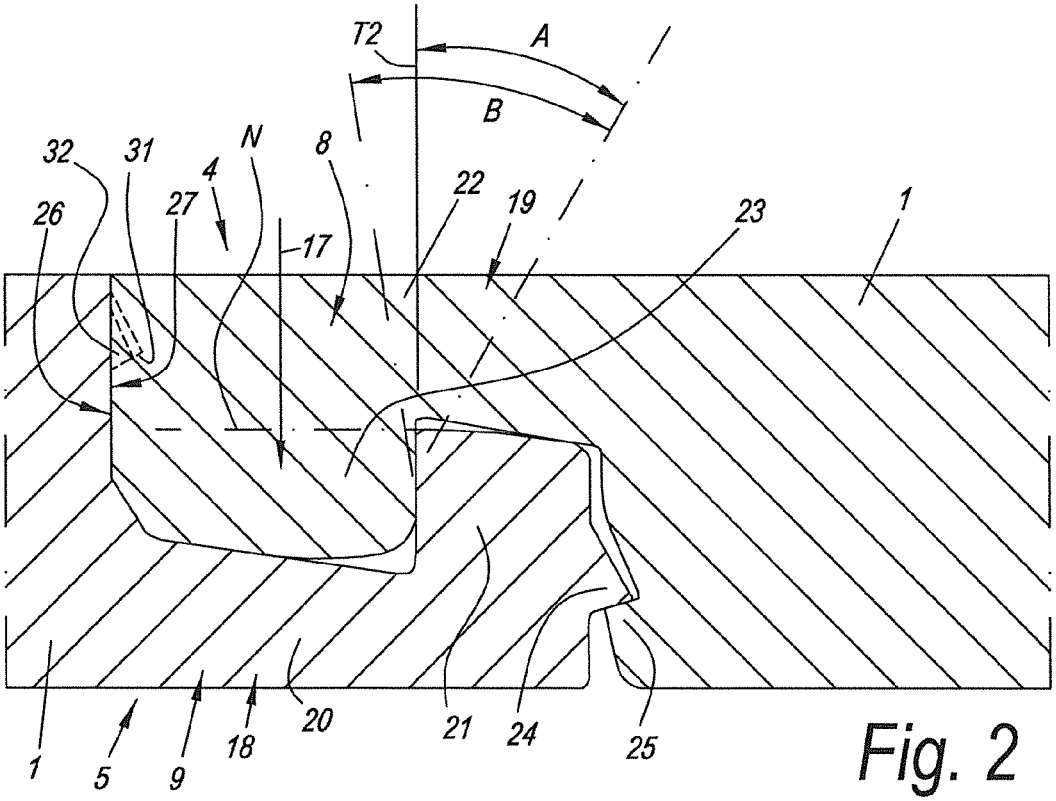
FIG. 2 represents the coupling parts on the short edges.
Figure 3:
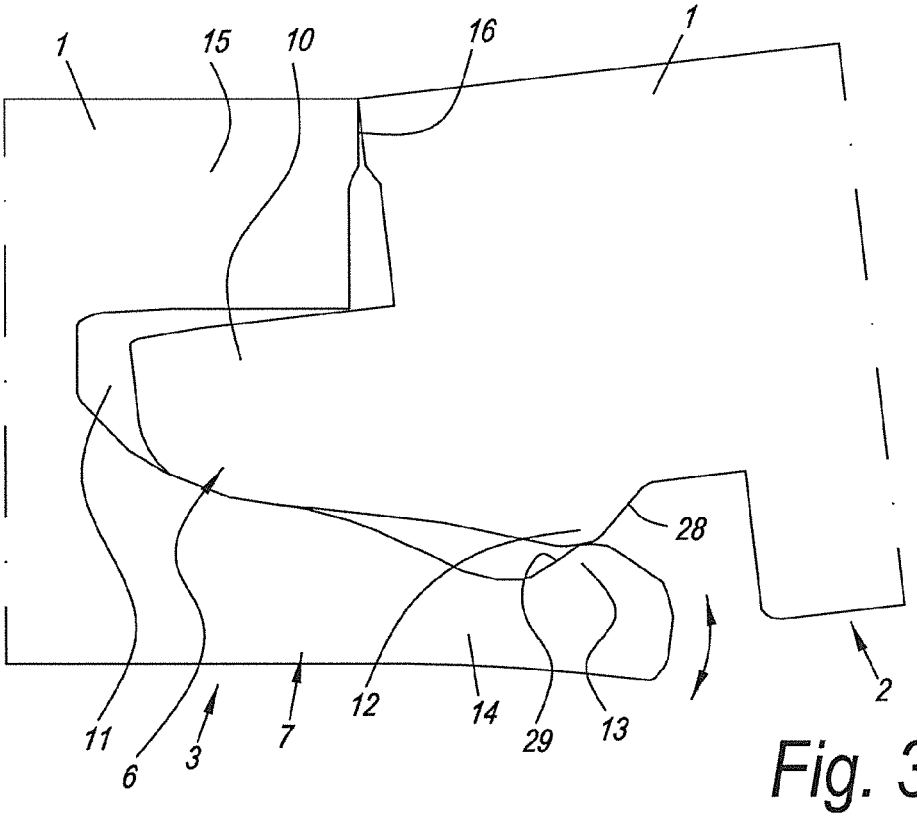
FIGS. 3 and 4 illustrate the coupling parts on the long sides for an embodiment according to the first aspect of the invention, in a condition during coupling and in a completely coupled condition, respectively.
Figure 4:
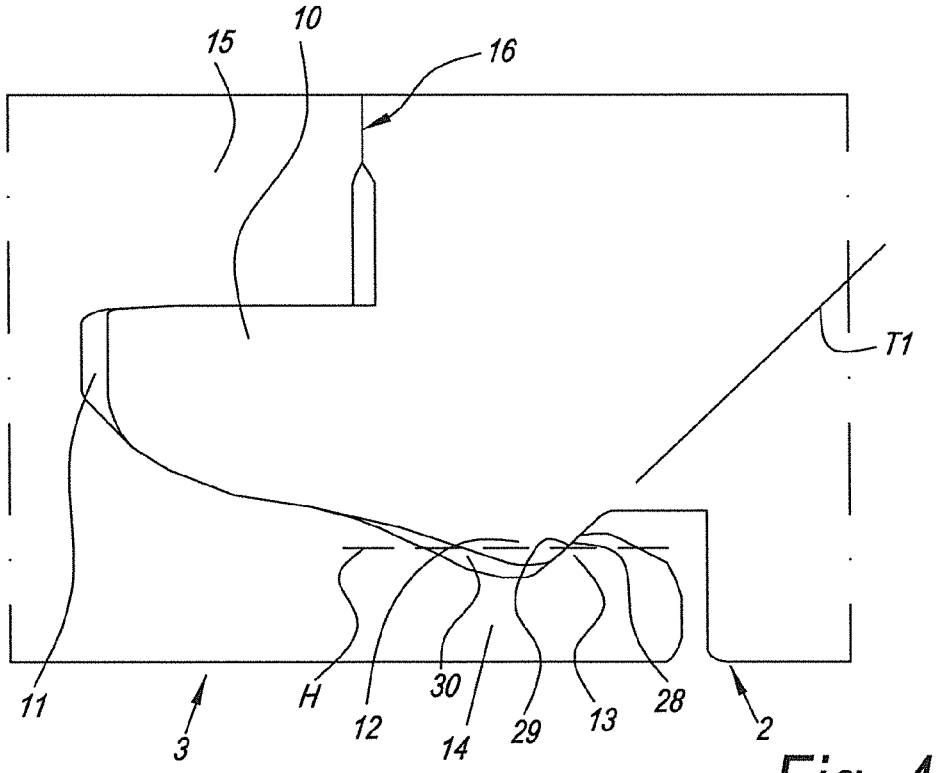

FIGS. 1 to 4 illustrate the first aspect of the invention, wherein FIG. 1 is a schematic representation of the floor covering, FIG. 2 in cross-section represents a possible embodiment of the short edges, whereas FIGS. 3 and 4 in not-crosshatched form illustrate cross-sections of the long sides or edges, in a condition during coupling and in a completely coupled condition, respectively.

As is represented in FIGS. 1 to 4, the invention, according to its first aspect, provides for a floor panel for forming a floor covering, wherein this floor panel 1 is rectangular and oblong and thus comprises a first pair of opposite edges 2-3, which form the long edges of the floor panel, as well as comprises a second pair of opposite edges 4-5, which form the short edges of the floor panel; wherein both pairs of opposite edges 2-3, 4-5 comprise coupling parts 6-7, 8-9, which allow that a plurality of such floor panels 1 mutually can be coupled to each other; wherein these coupling parts 6-7, 8-9, respectively, on both pairs of edges 2-3 and 4-5, form a first locking system, which, in a coupled condition of two of such floor panels, effects a locking in the plane of the floor panels and perpendicular to the respective edges, as well as form a second locking system, which, in a coupled condition of two of such floor panels, effects a locking transverse to the plane of the floor panels; wherein these coupling parts 6-7 on the first pair of opposite edges substantially are realized in the material of the floor panel itself; wherein the coupling parts of at least the first pair of opposite edges 2-3 are configured such that two of such floor panels 1 can be coupled to each other at these edges by means of a turning movement and to this aim these coupling parts 6-7 on the first pair of opposite edges consist of a tongue 10 and a groove 11, as well as of locking parts 12-13, which, in the coupled condition, prevent the shifting apart of the tongue and groove; wherein on the first pair of opposite edges the groove is bordered by a lower lip 14 and an upper lip 15, of which the lower lip 14 extends laterally up to beyond the distal extremity 16 of the upper lip; wherein the coupling parts on the second pair of edges are configured such that two of such floor panels can be coupled to each other at these edges by means of a downward movement 17 of one floor panel in respect to the other, more particularly such that a plurality of such floor panels can be coupled to each other by means of the so-called "fold-down" technique; wherein the first locking system of the second pair of edges is at least formed of an upward-directed lower hook-shaped part 18, which is situated on one of said two edges, in this case edge 5, and which comprises a distal extremity, as well as a downward-directed upper hook-shaped part 19, which is situated on the opposite edge 4, wherein the lower hook-shaped part 18 consists of a lip 20 with an upward-directed locking element 21, whereas the upper hook-shaped part 19 consists of a lip 22 with a downward-directed locking element 23; wherein the second locking system of the second pair of edges is at least formed by a locking part 24, which is situated on the distal extremity of the lower hook-shaped part, as well as a locking part 25, which cooperates therewith in the coupled condition of two of such floor panels, on the edge 4 which comprises the upper hook-shaped part 19; and wherein the distal extremity 26 of the upper hook-shaped part and the side 27 which, in coupled condition, is opposite thereto, are free from mutually vertically locking parts. The floor panel 1 has the characteristic that the coupling parts on the first pair of edges are configured such that during the turning into each other of two of such floor panels an elastic force has to be overcome during the turning movement, which force, during the turning into each other, first increases in order to subsequently decrease again; that the floor panels on the first pair of edges, in the final coupled condition of two of such floor panels, are coupled in horizontal direction free from play, or, if such play indeed exists, this play is less than 0.2 mm; that the aforementioned locking parts of the first locking system on the first pair of edges are formed at least of a locking part on the lower side of the tongue and a locking part on the aforementioned lower lip, which, by means of contact surfaces 28-29, which can cooperate with each other, result in the respective locking; and that the coupling parts on the first pair of edges in the coupled condition show one or both of the following characteristics:

- in the direction of the distal extremity of the tongue, at the same height H as the aforementioned contact surfaces 28-29, a free space 30 is present between the tongue and the opposite floor panel;
- the cooperation of the aforementioned contact surfaces defines a tangent line T1 which, in respect to the horizontal, forms an angle of at least 40 degrees, such in the direction as represented in the figures, in other words, seen from bottom to top outwardly inclined.

Herein, it is noted that the groove 11 has to be considered as the entire space which is situated between the distal extremity of the upper lip 16 and the distal extremity of the lower lip 14. By the herein above-mentioned term "tongue" thus the entire part cooperating therewith has to be understood. In other words, this means that the locking part 12 has to be considered a component of the tongue 10. The represented space 30, which is situated at the aforementioned height H distally in front of the locking part 12, thus by definition forms an example of "a free space 30 which is present at the height H between the tongue and the opposite floor panel".

FIG. 3 schematically shows that the aforementioned elastic force is supplied in that the coupling parts 6-7 are configured such that the locking parts 12 and 13 on tongue and groove, during the turning movement, can pass alongside each other exclusively by exertion of a force. Hereby, it becomes clear from this figure that in the represented example the elastic force at least, and in this case substantially, is the result of an elastic bending in the lower lip 14.

It is clear that in the further movement from the position represented in FIG. 3 into the position of FIG. 4, the lower lip 14 springs back, whereby the elastic force decreases. In the final condition, which is represented in FIG. 4, the lower lip 14 again is in a not elastically bent-out condition; however, it is clear that according to a variant in the end position also an elastic bending out of the lower lip 14 might remain, which usually then in fact is smaller than in the condition of FIG. 3.

It is also clear that during the turning movement of FIG. 3 the floor panels preferably contact each other in the proximity of their upper edge.

Due to the elastic force which manifests itself at least during a part of the aforementioned turning movement, at least during this part a certain tensioning force is created among the coupling parts 6-7. This has the consequence that, when the coupling parts 6-7 should have the tendency of mutually shifting in the longitudinal direction of the respective edges, a friction force must be overcome. This effect results in that the risk of such longitudinal shifting, which may occur as a result of the fact that the locking parts 24 and 25 are forced alongside each other during the fold-down movement, is minimized.

Figure 5:
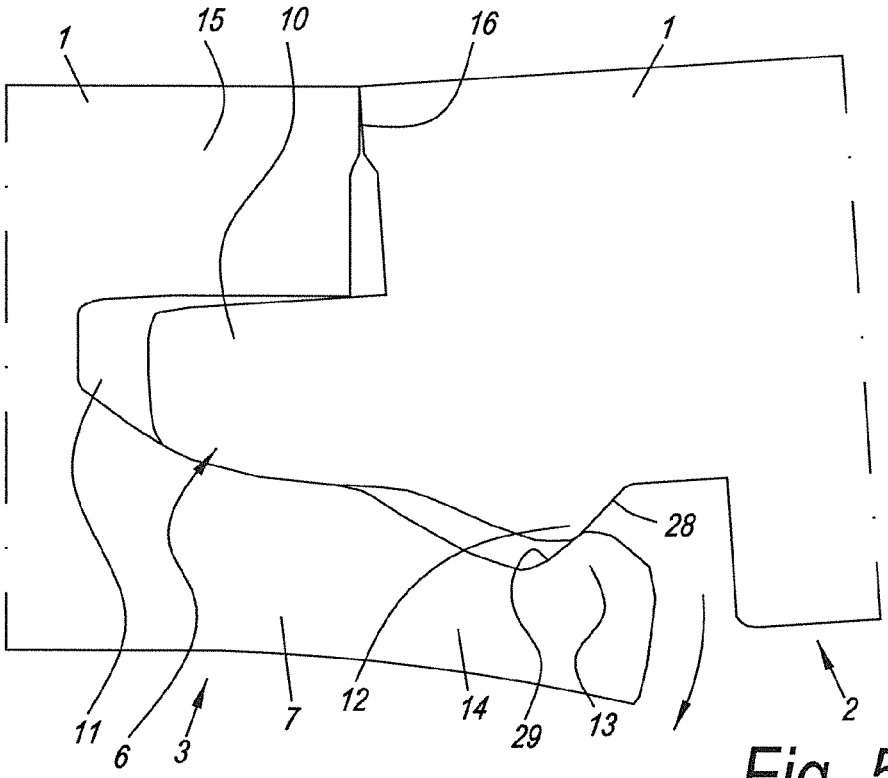
FIGS. 5 and 6 illustrate the coupling parts on the long sides for an embodiment according to the second aspect of the invention, in a condition during coupling and in a completely coupled condition, respectively.
Figure 6:
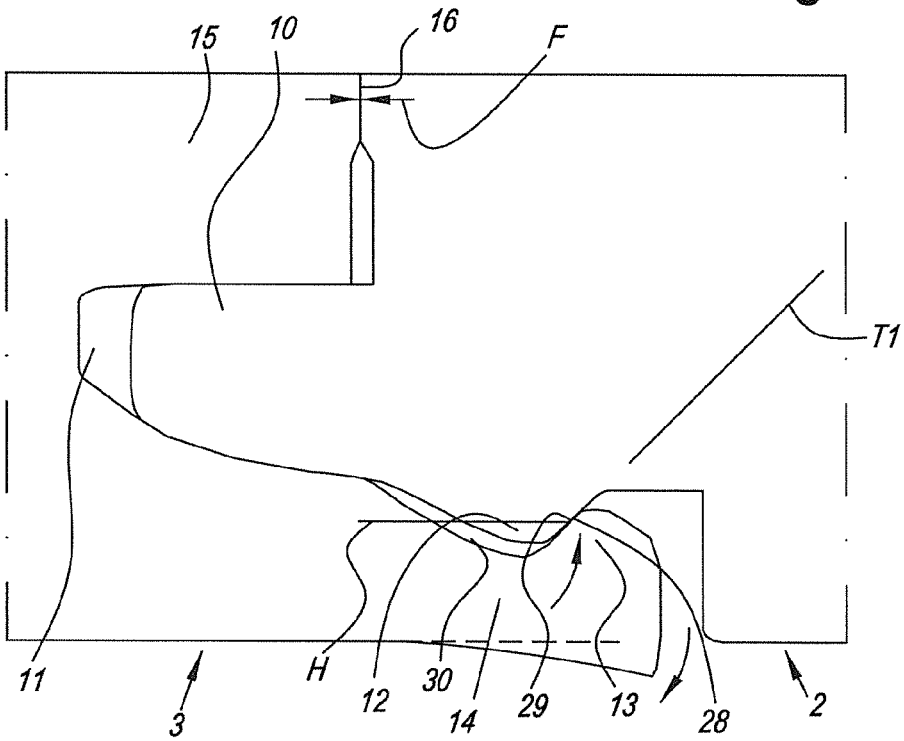

In FIGS. 5 and 6 schematically a variant of the coupling parts 8 and 9 is represented, which are configured such that, combined with an embodiment of the edges 2-3 according to FIG. 2, a floor panel 1 is obtained which fulfills the second aspect of the invention. Herein, then in fact a floor panel for forming a floor covering is provided, wherein this floor panel 1 is rectangular and oblong and thus comprises a first pair of opposite edges 2-3, which form the long edges of the floor panel, as well as comprises a second pair of opposite edges 4-5, which form the short edges of the floor panel; wherein both pairs of opposite edges 2-3 and 4-5 comprise coupling parts 6-7 and 8-9, which allow that a plurality of such floor panels 1 mutually can be coupled to each other; wherein these coupling parts 6-7 and 8-9 on both pairs of edges 2-3 and 4-5 form a first locking system, which, in a coupled condition of two of such floor panels, effects a locking in the plane of the floor panels and perpendicular to the respective edges, thus, horizontally, as well as form a second locking system, which, in a coupled condition of two of such floor panels, effects a locking transverse to the plane of the floor panels, thus, vertically; wherein these coupling parts 6-7 on the first pair of opposite edges substantially are realized in the material of the floor panel itself; wherein the coupling parts of at least the first pair of opposite edges 2-3 are configured such that two of such floor panels 1 can be coupled to each other at these edges by means of a turning movement and to this aim these coupling parts 6-7 on the first pair of opposite edges consist of a tongue 10 and a groove 11, as well as of locking parts 12-13, which, in the coupled condition, prevent the shifting apart of the tongue and groove; wherein on the first pair of opposite edges the groove is bordered by a lower lip 14 and an upper lip 15, of which the lower lip 14 extends laterally up to beyond the distal extremity 16 of the upper lip; wherein the coupling parts on the second pair of edges are configured such that two of such floor panels can be coupled to each other at these edges by means of a downward movement 17 of one floor panel in respect to the other, more particularly such that a plurality of such floor panels can be coupled to each other by means of the so-called "fold-down" technique; wherein the first locking system of the second pair of edges is at least formed of an upward-directed lower hook-shaped part 18, which is situated on one of said two edges 5 and which comprises a distal extremity, as well as a downward-directed upper hook-shaped part 19, which is situated on the opposite edge 4, wherein the lower hook-shaped part 18 consists of a lip 20 with an upward-directed locking element 21, whereas the upper hook-shaped part 19 consists of a lip 22 with a downward-directed locking element 23; wherein the second locking system of the second pair of edges is at least formed by a locking part 24, which is situated on the distal extremity of the lower hook-shaped part, as well as a locking part 25, which cooperates therewith in the coupled condition of two of such floor panels, on the edge which comprises the upper hook-shaped part; and wherein the distal extremity 26 of the upper hook-shaped part and the side 27 which, in coupled condition, is opposite thereto, are free from mutually vertically locking parts; with the particularity that the coupling parts on the first pair of edges are configured such that the floor panels on this first pair of edges in the final coupled condition of two of such floor panels in horizontal direction are coupled with a tensioning force F, which presses the floor panels at their upper edges substantially permanently towards each other, more particularly a so called "pre-tension", which tensioning force F is built up during the turning in.

As represented in FIGS. 5 and 6, the aforementioned locking parts of the first locking system on the first pair of edges are at least formed of a locking part 12 on the lower side of the tongue 10 and a locking part 13 on the aforementioned lower lip 14, which provide for the respective locking via contact surfaces 28-29, which can cooperate with each other.

The tensioning force is at least the result of a configuration which provides for that the lower lip 14 is elastically bent out in the final coupled condition, such as illustrated by means of FIG. 6.

It is clear that the coupling parts 6-7 can be configured such that the tensioning force permanently increases until the coupled condition is reached. According to another possibility, the tensioning force, during the turning in, also can go over a peak in order to finally still retain a permanent tension. It is clear that the tensioning force offers the same advantage as in an embodiment according to the first aspect.

FIG. 6 shows that the coupling parts on the first pair of edges in the coupled condition show the characteristic that in the direction of the distal extremity of the tongue, at the same height H as the aforementioned contact surfaces, a free space 30 is present between the tongue, including the locking part, and the opposite floor panel, and that the cooperation of the aforementioned contact surfaces defines a tangent line T1, which forms an angle of at least 40 degrees in respect to the horizontal. These characteristics promote and/or optimize the pre-tension effect.

Figure 7:
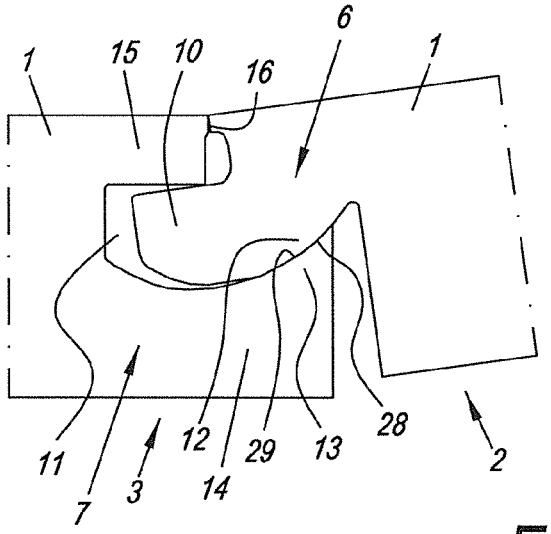
FIGS. 7 and 8 illustrate the coupling parts on the long sides for an embodiment according to the third aspect of the invention, in a condition during coupling and in a completely coupled condition, respectively.
Figure 8:
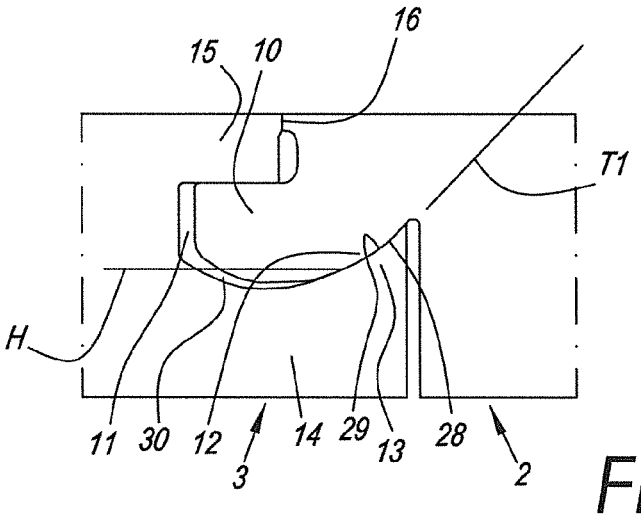

In FIGS. 7 and 8, schematically a variant is represented of the coupling parts 8 and 9, which are configured such that, combined with an embodiment of the edges 2-3 according to FIG. 2, a floor panel 1 is obtained which fulfills the third aspect of the invention. Herein, in fact a floor panel for forming a floor covering is provided, wherein this floor panel 1 is rectangular and oblong and thus comprises a first pair of opposite edges 2-3, which form the long edges of the floor panel, as well as comprises a second pair of opposite edges 4-5, which form the short edges of the floor panel; wherein both pairs of opposite edges 2-3 and 4-5 comprise coupling parts 6-7 and 8-9, which allow that a plurality of such floor panels 1 mutually can be coupled to each other; wherein these coupling parts 6-7 and 8-9, on both pairs of edges 2-3 and 4-5, form a first locking system, which, in a coupled condition of two of such floor panels, effects a locking in the plane of the floor panels and perpendicular to the respective edges, as well as form a second locking system, which, in a coupled condition of two of such floor panels, effects a locking transverse to the plane of the floor panels; wherein these coupling parts 6-7 on the first pair of opposite edges substantially are realized in the material of the floor panel itself; wherein the coupling parts of at least the first pair of opposite edges 2-3 are configured such that two such floor panels 1 can be coupled to each other at these edges by means of a turning movement and to this aim these coupling parts 6-7 on the first pair of opposite edges consist of a tongue 10 and a groove 11, as well as of locking parts 12-13, which, in the coupled condition, prevent the shifting apart of the tongue and groove; wherein on the first pair of opposite edges the groove is bordered by a lower lip 14 and an upper lip 15, of which the lower lip 14 extends laterally up to beyond the distal extremity 16 of the upper lip; wherein the coupling parts on the second pair of edges are configured such that two of such floor panels can be coupled to each other at these edges by means of a downward movement of one panel in respect to the other, more particularly such that a plurality of such floor panels can be coupled to each other by means of the so-called "fold-down" technique; wherein the first locking system of the second pair of edges is at least formed of an upward-directed lower hook-shaped part 18, which is situated on one of said two edges 5 and which comprises a distal extremity, as well as a downward-directed upper hook-shaped part or element 19, which is situated on the opposite edge 4, wherein the lower hook-shaped part 18 consists of a lip 20 with an upward-directed locking element 21, whereas the upper hook-shaped part 19 consists of a lip 22 with a downward-directed locking element 23; wherein the second locking system of the second pair of edges is at least formed by a locking part 24, which is situated on the distal extremity of the lower hook-shaped part, as well as a locking part 25, which cooperates therewith in the coupled condition of two of such floor panels, on the edge which comprises the upper hook-shaped part; wherein the distal extremity 26 of the upper hook-shaped part and the side 27 which, in coupled condition, is opposite thereto, are free from mutually vertically locking parts, with the particularity that the coupling parts on the first pair of edges are configured such that they allow a tensionless turning into each other up into the final coupled condition, more particularly without building up a so-called pre-tension, or without having to overcome a temporary elastic force.

By making use of a configuration of coupling parts 6-7 which turn into each other tensionless, a self-searching effect is created at the short edges, such that it can also be expected in this manner that the short edges end up in each other in a proper manner.

Herein, it is preferred that the floor panels at the first pair of edges in the final coupled condition of two of such floor panels are coupled free from play in the horizontal direction or, when such play indeed exists, this is less than 0.2 mm. Here, this relates to the condition at the upper edges, where the floor panels adjoin each other. In the case of floor panels with bevels, this, of course, is the location where the lower edges of the bevels adjoin each other.

In the embodiment of FIGS. 7 and 8, too, the aforementioned locking parts of the first locking system on the first pair of edges are formed at least by a locking part on the lower side of the tongue and a locking part on the aforementioned lower lip, which provide for the respective locking via contact surfaces, which can cooperate with each other.

In this example, too, the floor panels 1 are characterized in that the coupling parts on the first pair of edges in the coupled condition show the characteristic that in the direction of the distal extremity of the tongue, at the same height H as the aforementioned contact surfaces, a free space 30 is present between the tongue, including the locking part, and the opposite floor panel, and that the cooperation of the aforementioned contact surfaces define a tangent line T1, which forms an angle of at least 40 degrees in respect to the horizontal.

It is noted that in the embodiment of FIG. 2, the locking elements of the hook-shaped parts comprise locking surfaces, which provide for the horizontal locking and which have a tangent line T2, which is situated perpendicular to the plane of the floor panels. Alternatively, these locking surfaces also can be realized such that the tangent line in upward direction is inwardly or outwardly inclined, for example, within an angle range as indicated by B in FIG. 2. If the tangent line is outwardly directed, the angle A preferably is maximum 30 degrees.

FIG. 2 also illustrates that the locking part of the second locking system, which is situated on the distal extremity of the lower hook-shaped part, and the corresponding locking part on the other edge massively form part of the coupling parts or the floor panels, or at least are massively supported directly towards the back, and thus no grooves or the like are present there behind which have the purpose of creating movable parts, such over the majority of the length of the edge concerned.

According to deviating variants of the first, second and third aspect, the invention also relates to floor panels which are characterized in that, instead of the fact that the distal extremity of the upper hook-shaped part and the side situated opposite thereto in the coupled condition of two floor panels, are free from vertically locking parts, now indeed such locking parts 31-32 are present. This alternative is represented in dashed line in FIG. 2. In other words, this means that the invention also relates to three deviating aspects, wherein each time all characteristics of the first, second and third aspect are applied, with the exception of the fact that now indeed locking parts 31 and 32 are present on the edges concerned.

Herein, it is preferred that the locking surfaces formed thereby, thus, of the locking parts 31 and 32, in the coupled condition, are situated entirely above a horizontal level N, which is determined by the highest point of the upward-directed locking part of the lower hook-shaped part.

It is noted that generally it is valid that contact surfaces and locking surfaces do not have to be flat, however, may also be curved, thus, consist of curved surfaces.

FIGS. 3 to 8 also illustrate the characteristic that the aforementioned locking parts of the first pair of edges are provided with locking contact surfaces 28-29, which in the coupled condition are situated at least partially in the portion of the lower lip 14 which is situated beyond the distal extremity 16 of the upper lip 15.

FIG. 2 also illustrates the characteristic that the coupling parts on the second pair of edges are made in one piece from the material of the floor panels, preferably in the form of milled profiled parts.

The invention is primarily intended for synthetic floors, as described in the claims and the introduction, however, can also be applied with other floor panels.

It is noted that the locking parts 24-25 may have any form, as long as they provide for a vertical locking. The same is valid for the locking parts 31-32.

Further, it is noted that behind the distal extremity of the lower lip 14 preferably a free space is present, such that the distal side of the distal extremity is free.

According to an invention not included in the claims, a fold-down system is provided, with the characteristic that the coupling parts on the short sides provide for a vertical locking which is of such nature that the locking can be pulled apart vertically, in a non-damaging manner, by means of a de-folding movement. Starting from this fact, the form of the coupling parts can be determined by testing. It is clear that this can be realized in combination with the three independent aspects of the invention.

The present invention is in no way limited to the embodiments described by way of example and represented in the figures; on the contrary, such floor panels, and more particularly the coupling parts thereof, can be realized in various forms and dimensions, without leaving the scope of the invention.

The invention claimed is:

1. A floor panel for forming a floor covering, wherein this floor panel is rectangular and oblong and comprises: a first pair of opposite edges, which form the long edges of the floor panel, and a second pair of opposite edges, which form the short edges of the floor panel; wherein both pairs of opposite edges comprise coupling parts, which allow that a plurality of such floor panels mutually can be coupled to each other; wherein these coupling parts, on both pairs of edges, form a first locking system, which, in a coupled condition of two of such floor panels, effects a locking in the plane of the floor panels and perpendicular to the respective edges, and form a second locking system, which, in a coupled condition of two of such floor panels, effects a locking transverse to the plane of the floor panels; wherein these coupling parts on the first pair of opposite edges substantially are realized in the material of the floor panel itself, wherein the coupling parts of at least the first pair of opposite edges are configured such that two of such floor panels can be coupled to each other at these edges by means of a turning movement and to this aim these coupling parts on the first pair of opposite edges consist of a tongue and a groove, and of locking parts, which, in the coupled condition, prevent the shifting apart of the tongue and groove; wherein on the first pair of opposite edges the groove is bordered by a lower lip and an upper lip, of which the lower lip extends distally at a location beyond the distal extremity of the upper lip; wherein the coupling parts on the second pair of edges are configured such that two of such floor panels can be coupled to each other at these edges by means of a downward movement of one floor panel in respect to the other, such that a plurality of such floor panels can be coupled to each other by means of a "fold-down" technique; wherein the first locking system of the second pair of edges is at least formed of an upward-directed lower hook-shaped part, which is situated on one of said two edges and which comprises a distal extremity, and a downward-directed upper hook-shaped part, which is situated on the opposite edge, wherein the lower hook-shaped part consists of a lip with an upward-directed locking element, whereas the upper hook-shaped part consists of a lip with a downward-directed locking element; wherein the second locking system of the second pair of edges is at least formed by a locking part, which is situated on the distal extremity of the lower hook-shaped part, and a locking part, which cooperates therewith in the coupled condition of two of such floor panels, on the edge which comprises the upper hook-shaped part; wherein the distal extremity of the upper hook-shaped part and the side which, in a coupled condition, is opposite thereto, are free from mutually vertically locking portions; and wherein the coupling parts on the first pair of edges are configured such that the floor panels on this first pair of edges, in the final coupled condition of two of such floor panels, are coupled in a horizontal direction with a tensioning force which presses the floor panels at their upper edges substantially permanently towards each other by "pre-tension," which tensioning force is built up during the turning in, wherein the aforementioned locking parts of the first locking system on the first pair of edges are formed at least by a locking part on the lower side of the tongue and a locking part on said lower lip, which provide for the respective locking via contact surfaces arranged to cooperate with each other; wherein the lower lip is arranged to be elastically bent out in the final coupled condition relative to an uncoupled condition as a result of cooperation of the contact surfaces, wherein in a direction of the distal extremity of the tongue, at the same height (H) as the aforementioned contact surfaces, a free space is defined between the tongue and the opposite floor panel at a location directly adjacent to the contact surfaces, and wherein the free space extends vertically below the same height (H) of the aforementioned contact surfaces.

2. The floor panel of claim 1, wherein the coupling parts on the first pair of edges in the coupled condition show the characteristic that, in the direction of a distal extremity of the tongue, at the same height as said contact surfaces, a free space is present between the tongue and the opposite floor panel.

3. The floor panel of claim 1, wherein the locking elements of the hook-shaped parts comprise locking surfaces, which provide for the horizontal locking and determine a tangent line, which either is directed inward, and they manifest themselves as an undercut, or define a tangent line which is standing perpendicular to the plane of the floor panels, or define a tangent line which is directed outward, however, in the last case with an angle of maximum 30 degrees in respect to the vertical.

4. The floor panel of claim 1, wherein instead of the fact that the distal extremity of the upper hook-shaped part and the side situated opposite thereto in the coupled condition of two floor panels, are free from vertically locking parts, now indeed such locking parts are present; wherein the formed locking surfaces thereof, in the coupled condition, are situated entirely above a horizontal level, which is determined by the highest point of the upward-directed locking part of the lower hook-shaped part.

5. The floor panel of claim 1, wherein this floor panel substantially is realized on the basis of synthetic material and as a layer-shaped substrate.

6. The floor panel of claim 5, wherein it is a floor panel of the supple of a "resilient floor" type.

7. The floor panel of claim 1, wherein it substantially consists of a laminate panel with a substrate of MDF or HDF, or consists of an engineered-wood floor panel.

8. The floor panel of claim 1, wherein the contact surface defined by the lower lip is arranged to overlap the contact surface defined by the locking part on the lower side of the tongue when the upper lips of the first pair of opposite edges are aligned along a vertical plane in an uncoupled condition.

9. The floor panel of claim 1, wherein the lower lip is arranged to rotate relative to the locking part on the lower side of the tongue during the turning movement, during the turning movement, which force, during the turning into each other, first increases in order to subsequently decrease again as the contact surface defined by the lower lip engages the contact surface defined by the locking part on the lower side of the tongue.

10. The floor panel of claim 9, wherein the lower lip remains rotated in the coupled condition, wherein the contact surface defined by the lower lip is arranged at a different angle relative to the contact surface defined by the lower side of the tongue in an uncoupled condition of two of such floor panels when the upper lips of the first pair of opposite edges are aligned along a vertical plane in an uncoupled condition.

11. The floor panel of claim 1, wherein the cooperation of the contact surfaces defines a tangent line T1 which, in respect to the horizontal, forms an angle of at least 40 degrees, as seen from bottom to top outwardly inclined.

12. The floor panel of claim 1, wherein surfaces of the distal extremity of the upper hook-shaped part and the side which, in coupled condition, are free from mutually vertically locking portions extend solely vertically to a chamfered edge at the upper hook-shaped part extending downwardly and proximally.

* * * * *